United States Patent [19]

Rinaldi

[11] 4,170,954

[45] Oct. 16, 1979

[54] SEMI-SUBMERSIBLE VESSEL

[76] Inventor: Victor Rinaldi, No. 9 Calle Cuello URB "La Florida", Caracas, Venezuela

[21] Appl. No.: 820,461

[22] Filed: Aug. 1, 1977

Related U.S. Application Data

[63] Continuation-in-part of Ser. No. 699,089, Jun. 23, 1976, abandoned.

[30] Foreign Application Priority Data

Jun. 27, 1975 [FR] France ..... 75 20349

[51] Int. Cl.[2] ..... B63B 35/44

[52] U.S. Cl. ..... 114/265; 9/8 P; 114/256; 405/206

[58] Field of Search ..... 9/1.1, 8 R, 8 P; 114/264, 265, 267, 256, 257; 61/94, 98, 87, 88, 95, 86, 101; 405/206, 207

[56] References Cited

U.S. PATENT DOCUMENTS 3,824,942 7/1974 Stafford et al. ..... 61/101 X 4,010,704 3/1977 Mayo et al. ..... 114/267

FOREIGN PATENT DOCUMENTS 1444327 7/1976 United Kingdom ..... 114/264

*Primary Examiner*—Trygve M. Blix
*Assistant Examiner*—Sherman D. Basinger
*Attorney, Agent, or Firm*—Bucknam and Archer

[57] ABSTRACT

Semi-submersible vessels are described comprising a sealed chamber with curved surfaces, a partially immersable support structure secured to the chamber and a platform or deck carried by the support structure. Preferably the sealed chamber comprises a plurality of toroidal storage reservoirs and ballast tanks. The lower portion of the vessel formed by the closed chamber opens at its upper portion toward the support structure and at its lower portion through an opening for communication with the liquid of the environment. The vessel additionally comprises a plurality of openings in the proximity of the larger perimeter of the chamber. According to another embodiment, the concavity of the chamber is directed downwardly.

21 Claims, 7 Drawing Figures

FIG. 3
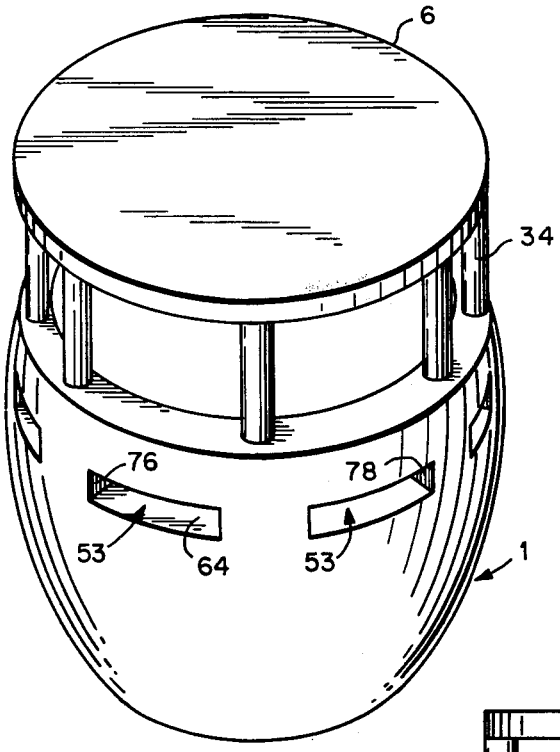
FIG. 4
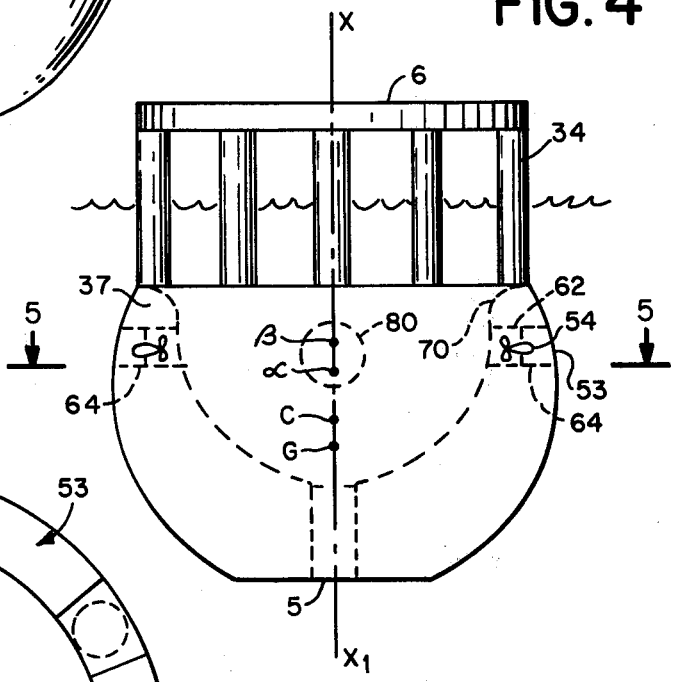
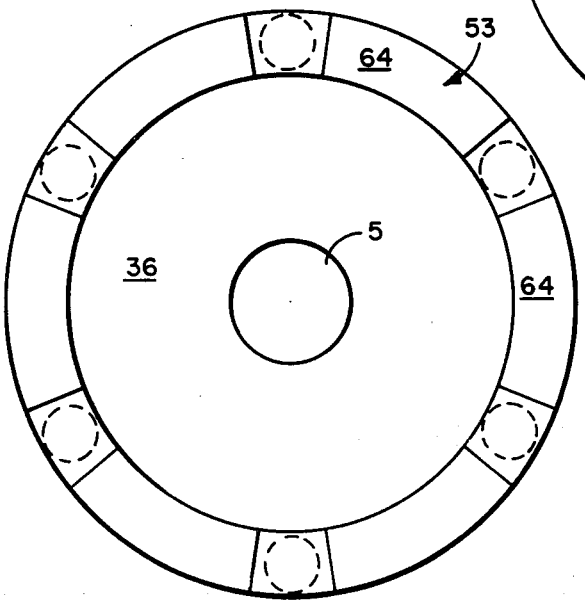
FIG. 5

SEMI-SUBMERSIBLE VESSEL

This application is a Continuation-in-part of my application Ser. No. 699,089, filed June 23, 1976 the subject matter of which is incorporated herein by reference. Ser. No. 699,089 has now been abandoned in favor of Ser. No. 921,173, filed July 3, 1978.

The present invention relates to semi-submersible vessels and more especially to marine platforms which may be used, in various embodiments as loading stations in oceanic waters and deep waters, drilling platforms, and mobile or stationary bulk loading vessels.

The general layout of a semi-submersible structure is the following: a horizontal deck is disposed at the upper level for the purpose of supporting working equipment. In all cases it is to be protected, as far as possible, against the action of swell. The keel is formed of an assembly of vertical cells or piers which connect this deck to a skeleton situated at a lower submerged level and either formed of parallel or intersecting horizontal cylinders or of independent caissons, the rigidity of the assembly being ensured by cross bars. Such a design affords a stability of the deck in the swell which, although greater than that of a conventional ship floating entirely at the surface nevertheless remains affected by roll and pounding, especially under conditions of heavy seas. According to this design the number of floatation cells is of little importance. The volume intercepted by the waves is great because of the necessity of holding considerable loads on the deck. On the other hand, for economic reasons and of problems of stresses in the structure it is difficult to construct according to this design huge structures the inertia of which would be a decisive factor in their stability.

The principal aim of the invention is to offer a type of semi-submersible structure which may be constructed economically of very large size and which has very good stability in a swell.

Such a vessel may be used as a working tool and a scientific tool for the exploitation and exploration of oceanic resources in fields as varied as aquaculture, marine oil, the extraction of polymetallic nodules from the sea beds or the extraction of thermal energy from the sea.

According to the invention there is provided a semi-submersible vessel comprising a sealed closed chamber of variable ballast at the lower portion, on which there is secured a support structure which is partially immersable in use and which carries at its upper portion a horizontal deck.

According to one embodiment the deck rests on the top of the sealed chamber through the intermediary of columns the buoyancy of which is positive. The sealed chamber is utilized for storing various fluids the density of which is generally lower than that of sea water. This chamber is provided with internal tanks as well as with a ballast of concrete, so as to adjust the draught of the vessel and to ensure it of a major righting moment by the control of the displacement of the center of gravity under the center of buoyancy of the immersed portions of the vessel.

Application Ser. No. 699,089 describes a semisubmersible vessel comprising in one embodiment one module formed by a sealed closed chamber, a support structure secured to the chamber, the structure being partially immersable in use, and a horizontal deck carried by the upper portion of the support structure, the lower portion of the vessel formed by the closed chamber having an ovoidal form truncated along a plane perpendicular to the axis of symmetry, the lower portion of the vessel formed by the closed chamber opening at its upper portion toward the support structure and at its lower portion through an opening for communication with the liquid environment. The ovoidal form illustrated in Application Ser. No. 699,089 is essentially an ovoid shell so truncated along the plane perpendicular to the axis of symmetry as to eliminate the more pointed portion of the shell and to retain the opposite portion which is nearly hemispherical.

The vessel described in Ser. No. 699,089 with one module has a very good stability in rough seaways mainly because of the shape of its chamber and because the thickness of the chamber is such that the external and internal walls of the chamber form the majority of its immersed hull, thus permitting the vessel to have the great majority of the hydrostatic forces working upon it to traverse a compact zone which surrounds its geometric center. The geometric center lies near the instantaneous axis of rotation of the vessel. The volume of this compact zone is small in comparison with the total volume of the chamber.

The present invention covers various shapes of the chamber which permit to achieve substantial convergence of the lines of action of the hydrostatic forces, about 75% of the total hydrostatic forces acting on the chamber. This convergence can be achieved for example if the external and internal walls are "generally spherical surfaces". By the expression "generally spherical surfaces" there are meant not only surfaces which are entirely and truly spherical but also curved surfaces which may depart from the truly spherical by minor accidentally occurring unevennesses and/or by the fact that these surfaces are totally or partly formed of non-spherical, curved or flat elements, for example portions of paraboloids and/or flat panels in the form of triangles, hexagons or other polygons, and/or by the fact that the surfaces are not completely spherical in the sense that a minor portion, for example a small zone at one base, may be absent or not have been replaced and/or completed by a surface such as a conical flat or a differently curved surface, provided that the major portion of the surface is sufficiently close to a spherical surface for the lines of action of the great majority of hydrostatic forces acting on this surface to traverse a small compact zone which surrounds its geometric center and the volume of which is small in comparison to the total volume circumscribed by the surface.

The present invention also describes a modification which permits an improved heave motion of the semi-submersible vessel without affecting its roll and pitch motion. This modification comprises several openings across the larger perimeter of the chamber at about the same level. The openings are preferably equally spaced around the larger perimeter of the chamber, which may be the upper or the lower portion.

For example the openings are located in line with the interstices between the columns, the total number of openings being equal to the total number of columns. These openings by permitting a flow of water between the upper parts of the concave cavity formed by the chamber and the surrounding environment suppress the slow random variation of the mean pressure of the water in the upper part of the concave cavity which variation of the mean pressure is caused by the random sea waves and which induces a slow random variation of the draft of the vessel. It is preferable that the upper wall and the lower walls of the openings be essentially horizontal and the side walls essentially parallel so that the hydrostatic forces acting upon them may essentially offset each other because they do not traverse the small compact zone as described hereinabove. To state the matter in different words, with the two internal and external walls essentially spherical, a majority of the lines of action of the hydrostatic forces acting on the chamber traverse the small compact zone and this effect is achieved when the two walls constitute the majority of the total surface of the chamber. The surface corresponding to the horizontal portions of the chamber and the portion where the opening 5 is located only constitute a minor portion of the total surface of the chamber. In view of the fact that the openings are located around the perimeter of the chamber, the lines of action of the hydrostatic forces acting on the upper wall essentially offset the forces acting on the lower wall of each opening and similarly the forces acting on one side wall of the opening are essentially offset by the forces acting on the opposite side wall. The net result is that although the lines of forces acting on the openings do not go through the small compact zone and obviously do not converge, they do not interfere with the stability of the vessel achieved by the essential convergence of the remainder of the lines of action of the hydrostatic forces.

According to one embodiment of the invention the upper wall of the chamber is curved.

According to another embodiment of the invention propulsion elements can be placed in the openings.

The invention will become better understood from reading the following description of several exemplary embodiments illustrated in the accompanying drawings, in which:

FIG. 3 is a view partially in perspective of a modification of the vessel of FIG. 1 or 2 showing the openings;

FIG. 4 is a diametrical cross section taken along the vertical axis of the symmetry of FIG. 3;

FIG. 5 is a plan top view of the vessel of FIG. 3;

Figure 1:
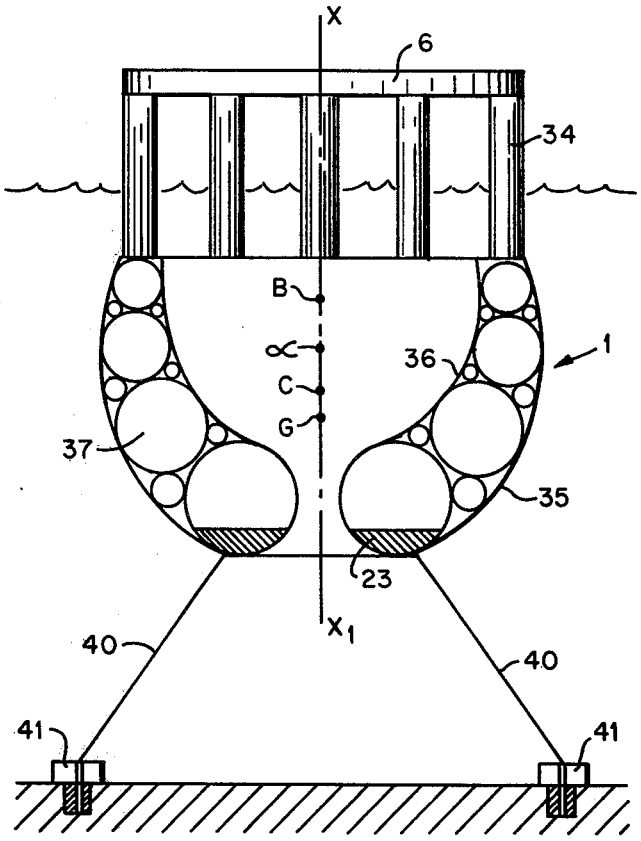
FIG. 1 is a view in axial section of an embodiment of a semi-submersible vessel having a generally spherical chamber.

FIG. 1 shows a semi-submersible vessel comprising a closed, sealed chamber 1 having a main variable ballast compartment 23 at its lower portion, and to which there is secured a structure formed of columns 34 which carries a horizontal deck 6 at its upper portion. The chamber 1 is normally submerged while the columns 34 of the structure are partially immersed. The internal surface of the chamber forms an opening 5 in the central part at the bottom of the cavity.

The chamber 1 is defined by an outer wall 35 formed of a generally spherical zone the centre $\alpha$ of which is situated on the axis of symmetry $xx_1$ of the chamber and an inner wall 36 formed by a generally spherical zone the center $\beta$ of which is situated on the axis of symmetry $xx_1$ of the chamber. These respective geometric centers $\alpha$ and $\beta$ of the generally spherical zones are situated on the geometric axis at a mutual spacing which is much less than the radius of the inner wall, for instance less than 1/10 of the radius of the inner wall. Preferably both geometric centers $\alpha$ and $\beta$ are located in the interior of the concave cavity defined by the internal wall of the chamber, because with this arrangement the mass of the liquid inside the concave cavity can be dynamically coupled with the mass of the vessel when the vessel is moving for instance under the effect of rough seaways and improved stability is achieved by this added mass effect.

The center of buoyancy C of the immersed parts is located on the axis of symmetry beneath the geometric centres $\alpha$ and $\beta$.

If the weight were to be concentrated at the center of buoyancy C the body would be in static equilibrium and would be subject to free roll as a result of the action of the waves; but by virtue of its center of gravity G being shifted below its centre of buoyancy C the vessel is unbalanced and swings like a pendulum about an axis of rotation to which the natural period of oscillation applies.

The vessel is ballasted in a fixed manner, more particularly by means of concrete in the ballast compartment 23 (FIGS. 1 and 2) which partly furnishes the righting moments necessary for keeping the deck 6 horizontal.

The interior of the chamber is generally divided into a plurality of toroidal spaces 37 (FIG. 1) coaxial with the axis of symmetry $xx_1$ of the chamber 1, or a plurality of cylindrical or annular spaces 38 (FIG. 2) associated with at least one toroidal space 37 at the upper portion of the chamber 1. This toroidal space 37 may be used as the main float.

The inner wall 36 defines a generally spherical cavity 39 which is open at its upper portion with its concavity directed toward the water level and which opens at the lower portion of the chamber 1 via the opening 5.

According to one embodiment, the upper wall of the cavity is a plane surface. The closed chamber may be formed of a hull of which at least the lower portion is made of prestressed concrete. In the embodiment of FIG. 1 the vessel is moored to the bottom by cables 40 secured to dead weights on tethering bolts or anchors 41.

Figure 2:
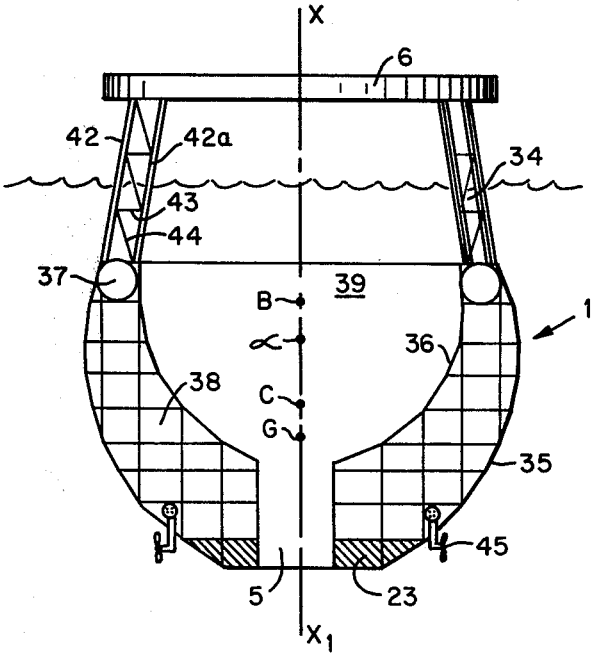
FIG. 2 is a view similar to FIG. 1 but showing a further embodiment of a vessel according to the invention.

In FIG. 2 there is shown a vessel wherein a support structure in the form of frustum of a cone supports the deck 6. The support structure is in the form of a network having two tubular skins which are each comprised of columns 42, **42*a* the axes of which coincide with the generatrices of the frustum of cone and which are interconnected by horizontal tubular cross-bars 43. Inclined tubular cross bars 44** link the skins and maintain them in rigid mutual relationship.

On the periphery of the chamber 1 there may be mounted, as shown in FIG. 2, propulsion motor groups 45 which are intended for its independent displacement and manoeuvering. These propulsion means are mounted so as to be individually rotatable about a vertical axis and permit propulsion in any direction.

By reference to FIGS. 3, 4, 5 and 7, numeral 53 designates the openings. It is preferable that the upper and lower wall 62 and 64 be essentially horizontal and that the side walls 76 and 78 be essentially vertical and parallel to each other so that the hydrostatic forces acting on them may essentially offset each other as explained hereinabove. The term "small compact zone" as used herein refers to the zone marked for instance in dotted lines in FIG. 4 and designated by numeral 80. This zone is not necessarily spherical but is compact. The term "small" as herein used means that the volume of this zone is not greater than 1/100 of the total volume of the chamber.

As shown in FIGS. 3 and 5, the openings occupy in total length at least three-quarters of the larger perimeter of the chamber. It is preferable that the columns be essentially equally spaced and that each opening be in line with each of the interstices between the columns, as shown in FIG. 3.

Figure 6:
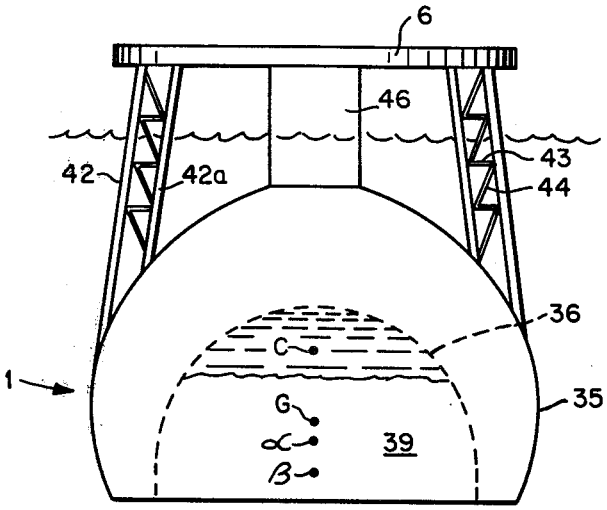
FIG. 6 is an elevational view of another embodiment of vessel, the concavity of which is directed downwardly.
Figure 7:
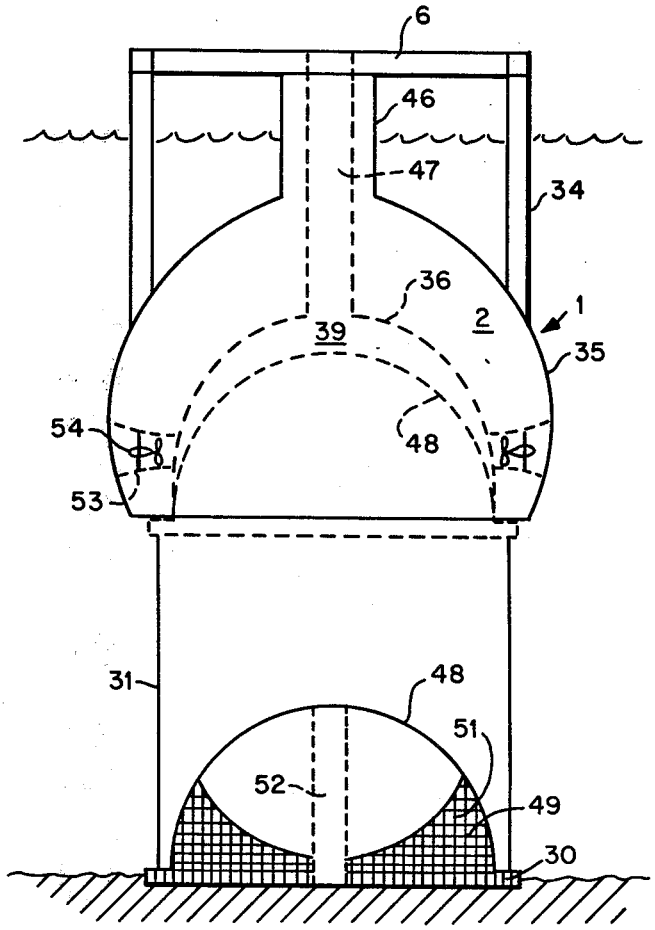
FIG. 7 is an elevational view of another embodiment in which the concavity of the chamber is directed downwardly. Openings along the larger perimeter of the chamber may be present also in the embodiments of FIGS. 6 and 7.

In FIGS. 6 and 7 there is shown a semi-submersible vessel which is comprised of the same elements as in FIGS. 1–5 but the concavity of the chamber 1 is directed downward, that is to say away from the surface of the water level.

The linkage between the sealed chamber 1 and the deck 6 is formed either by means of a network as in FIG. 6 or by means of columns 34 as in FIG. 7, the assembly being completed by a central vertical column 46 having a shaft 47 adapted to permit various means and particularly drilling means to pass therethrough.

The chamber is unbalanced in such manner that its center of gravity G is situated proximate and above the geometric centers $\alpha$ and $\beta$ of the external 35 and internal 36 curved surfaces of the chamber. According to one embodiment of the invention, the upper wall of the chamber is curved as shown by numeral 70 in FIG. 4.

The moment of stability of the vessel is obtained by virtue of the fact that the center of gravity G is below the center of buoyancy C of the immersed portions of the vessel, which is very close to that of the chamber because of the small volume displaced by the immersed portion of the columns 46 and 34 relative to the displacement of the chamber.

The cavity 39 envisaged below the chamber 1 makes it possible to transport and to position large equipments, especially under-water tanks for storing crude oil.

In FIG. 7 there is shown a reservoir 48 which comprises an upwardly curved dome 49 of plane concave lenticular form. The dome 49 is made either of concrete or of steel with cells 51 which are intended to become lighter when they are partly or totally empty.

Inside the reservoir 48 there is provided a shaft 52 intended to enable drilling operations to be carried out from the deck of the vessel.

The dome 49, or indeed the chamber itself, may provide, in urgent cases, an immense reservoir for storing crude oil by utilising the inverted bell formed by the chamber.

Thus in the event of a leakage from the underwater reservoir and even when the internal storage reservoirs are full or of limited capacity it is possible temporarily to store crude oil in the central chamber itself of the vessel.

Should the compartments in the wall of the chamber 1 leak and lose their buoyancy, then the vessel can be kept afloat by injecting compressed air under the chamber the central shaft of which is hermetically closed.

As shown in FIG. 4, numeral 54 on the periphery of the chamber designates propulsion members. They are located preferably in the interior of the openings for better protection.

What is claimed is:

1. A semi-submersible vessel comprising a completely submerged sealed closed chamber, a deck fixed upon the chamber by means of a semi-submerged support structure, the chamber being defined by external and internal walls each forming a curved surface, said internal wall defining a concave cavity open at its two ends, the internal surface of said chamber forming an opening in the central part at the bottom of the cavity, the two surfaces forming the majority of the external surfaces of the chamber, the great majority of the lines of action of the hydrostatic forces acting on said curved surfaces traversing a compact zone which surrounds the geometric center of the chamber, the volume of said compact zone being small in comparison to the total volume of the chamber, additionally comprising a plurality of openings located in the proximity of the larger perimeter of the chamber, the total length of the openings being at least three quarters of the larger perimeter of the chamber.

2. The vessel according to claim 1 wherein said curved surfaces form a major spherical segment and the geometric centers of the internal and external walls are located in the interior of the concave cavity defined by the internal wall of the chamber.

3. A vessel according to claim 1 wherein the concavity of the chamber is directed upwardly, the center of gravity of the vessel is situated on the axis of symmetry beneath the center of buoyancy and beneath the geometric centers of the internal and external curved surfaces of the chamber.

4. A vessel according to claim 3 wherein the upper wall of the chamber is curved.

5. A vessel according to claim 1, wherein the support structure is formed of a plurality of vertical columns which are regularly spaced about the periphery of the deck.

6. A vessel according to claim 5 wherein said vertical columns are essentially equally spaced and each opening is in line with each of the interstices between the columns.

7. The vessel according to claim 1 wherein the distance which separates the two geometric centers is very small relative to the radius of curvature of the internal wall of the chamber.

8. The vessel according to claim 1 wherein said small compact zone is located within said concave cavity.

9. A vessel according to claim 8 wherein the upper and lower wall of each opening is essentially horizontal.

10. A vessel according to claim 8 wherein the two side walls of each opening are essentially vertical and parallel.

11. A vessel according to claim 1 wherein the support structure has a frustoconical shape.

12. A vessel according to claim 11 wherein the support structure is made of columns the axes of which coincide with the generatrices of the frustum of a cone.

13. A vessel according to claim 1 wherein the concavity of the chamber is directed downwardly, the center of gravity of the vessel being situated beneath the center of buoyancy and above the geometric centers of the internal and external surfaces of the chamber.

14. The vessel according to claim 13 wherein the support structure is in the form of a network having two tubular skins which are each comprised of columns the axes of which coincide with the generatrices of the frustum of cone and which are interconnected by horizontal tubular cross-bars.

15. A vessel according to claim 1 wherein the central cavity of the sealed chamber has mounted therein in removable manner a storage reservoir having an upwardly oriented generally spherical dome and a planar base adapted to rest on the underwater bottom.

16. A vessel according to claim 1 additionally comprising propulsion members disposed in said openings.

17. A vessel according to claim 1 wherein the closed chamber is formed of a hull of which at least the lower portion is mainly made of prestressed concrete.

18. A vessel according to claim 1 wherein said sealed closed chamber comprises a plurality of storage reservoirs and ballast tanks, and a permanent fixed ballast at the lower part of the chamber.

19. A vessel according to claim 1 wherein the chamber is axisymmetrical, with the axis of symmetry being vertical.

20. A vessel according to claim 1 wherein the concavity of the chamber is directed downwardly and the gravity center and the buoyancy center of the vessel are both located above said geometric centers.

21. A vessel according to claim 1 wherein the upper wall of the cavity is a plane surface.

* * * * *